US007823564B2

(12) United States Patent
Edoardo et al.

(10) Patent No.: US 7,823,564 B2
(45) Date of Patent: Nov. 2, 2010

(54) COUPLING ARRANGEMENT AND CONNECTION ASSEMBLY

(75) Inventors: Giorgetti Edoardo, Rosignano Marittimo (IT); Latini Massimo, Empoli (IT); Marc Daniel, Livorno (IT)

(73) Assignee: Continental Automotive GmbH, Hannover (DE)

( * ) Notice: Subject to any disclaimer, the term of this patent is extended or adjusted under 35 U.S.C. 154(b) by 75 days.

(21) Appl. No.: 12/328,641

(22) Filed: Dec. 4, 2008

(65) Prior Publication Data

US 2009/0145407 A1 Jun. 11, 2009

(30) Foreign Application Priority Data

Dec. 7, 2007 (EP) ..... 07023779
Oct. 28, 2008 (EP) ..... 08105680

(51) Int. Cl.
*F02M 61/14* (2006.01)
*F02M 61/18* (2006.01)

(52) U.S. Cl. ..... 123/470; 123/456

(58) Field of Classification Search ..... 123/470, 123/468, 469, 456, 447, 467; 239/600
See application file for complete search history.

(56) References Cited

U.S. PATENT DOCUMENTS 5,167,213 A * 12/1992 Bassler et al. ..... 123/470
5,209,204 A * 5/1993 Bodenhausen et al. ..... 123/470
6,148,797 A 11/2000 Gmelin ..... 123/456
7,004,151 B2 * 2/2006 Zdroik ..... 123/516
2008/0105236 A1 5/2008 Scheffel et al. ..... 123/470

FOREIGN PATENT DOCUMENTS

DE 39 11 159 A1 4/1989
DE 197 53 102 A1 12/1997
EP 1 255 038 B1 9/2004
GB 2 270 054 A1 3/1994
WO WO 2005/059348 A2 6/2005

* cited by examiner

*Primary Examiner*—Mahmoud Gimie
(74) *Attorney, Agent, or Firm*—King & Spalding L.L.P.

(57) ABSTRACT

A coupling arrangement (12) with a housing (6) has a first locking part (18), a locking element (14) and a ring (16), which is arranged intermediate the locking element (14) and the housing (6). The locking element (14) is cylindrical having a center axis (X) and has a second locking part (28) and at least one locking contour (30) having a first end (32) designed to take in a respective pin (34) of a connecting element (36) to disable rotational movement of the connecting element (36) via positive locking. The ring (16), the first locking part (18) and the second locking part (28) are designed and arranged such as to form a positive locking at least in one direction of the center axis (X) between the housing (6) and the locking element (14) via the ring (16).

20 Claims, 3 Drawing Sheets

COUPLING ARRANGEMENT AND CONNECTION ASSEMBLY

CROSS-REFERENCE TO RELATED APPLICATIONS

This application claims priority to EP Patent Application No. 07023779 filed Dec. 12, 2007, and EP Patent Application No. 08105680.6 filed Oct. 28, 2008. The complete disclosure of the above-identified applications are hereby fully incorporated herein by reference.

TECHNICAL FIELD

The invention relates to a coupling arrangement and a connection assembly for coupling a connection body to a connecting element. Such a coupling arrangement and also such a connection assembly may be used in a fluid injection system, in particular for an internal combustion engine.

BACKGROUND

EP1255038B1 discloses a fuel injection system for the direct injection of fuel into at least one combustion space of an internal combustion engine. The fuel injection system has at least one fuel injection valve for each combustion space. The fuel injection valve can be inserted in each case at an injection portion into an assigned receiving board formed on a cylinder head of the internal combustion engine. The injection valve is connected to the pipe via two detents, one between an adapter and a retaining element and another between the retaining element and a connecting element, which is connected to the pipe.

SUMMARY

According to various embodiments, a coupling arrangement and a connection assembly can be created which enable a proper flexible and simple coupling of a connection body to a connecting element, for example in the case of a fluid injection system.

According to an embodiment, a coupling arrangement may comprise a housing comprising a first locking part, a locking element which is cylindrical having a center axis comprising—a second locking part, and—at least one locking contour having a first end designed to take in a respective pin of a connecting element to disable rotational movement of the connecting element via positive locking, and a ring, which is arranged intermediate the locking element and the housing, the ring, the first locking part and the second locking part being designed and arranged such as to form a positive locking at least in one direction of the center axis between the housing and the locking element via the ring.

According to a further embodiment, the first locking part of the housing may comprise a first protrusion designed to form a first area of contact for the ring. According to a further embodiment, the first locking part of the housing may comprise a first groove designed to at least partly take in the ring. According to a further embodiment, at a first axial end of the first groove the housing may have a larger outer diameter than at a second axial end of the first groove. According to a further embodiment, the second locking part of the locking element may comprise a second protrusion designed to form a second area of contact for the ring. According to a further embodiment, the second locking part of the locking element may comprise a second groove designed to at least partly take in the ring. According to a further embodiment, at a first axial end of the second groove the locking element may have a larger inner diameter than at a second axial end of the second groove. According to a further embodiment, the locking element may comprise two side portions connected through an intermediate portion, the first side portion having a larger inner diameter than the second side portion with the first side portion comprising the locking contour and the second side portion comprising the second locking part. According to a further embodiment, at least one of the outer diameter of the housing at the first axial end of the first groove and the diameter of the housing at the second axial end of the first groove may be smaller than the inner diameter of the locking element. According to a further embodiment, at least one of the outer diameter of the housing at the first protrusion and at the part of the housing along the center axis extending away from the first area of contact may be smaller than the inner diameter of the locking element. According to a further embodiment, the ring can be fixed to at least one of the first protrusion and the first groove of the housing.

According to another embodiment, a connection assembly for connecting an injector to a fluid supply may comprise such a coupling arrangement, wherein the housing forms part of the injector, and wherein the connecting element, which is fixed to a pipe of the fluid supply, communicates with the pipe through a fluid recess at a first axial end area of the connecting element.

According to a further embodiment, the respective locking contour of the locking element and the respective pin of the connecting element can be designed and arranged such as to form a positive locking at least in one direction of the center axis between the locking element and the connecting element. According to a further embodiment, the connection assembly may comprise three pins of the connecting element and three locking contours of the locking element each having the first end designed to take in the respective pin of the connecting element to disable rotational movement of the connecting element via positive locking. According to a further embodiment, the connection assembly may comprise an outer spring, which is arranged intermediate the pipe and the locking element, the outer spring being designed and arranged such as to force the locking element away from the pipe. According to a further embodiment, the connection assembly may comprise an inner spring, which is arranged in the connecting element having a smaller diameter than the outer spring, the inner spring being designed and arranged such as to force the housing of the injector away from the pipe.

BRIEF DESCRIPTION OF THE DRAWINGS

The invention is explained in the following with the help of schematic drawings.

These are as follows.

Elements with the same design or function that appear in the different illustrations are identified by the same reference characters.

DETAILED DESCRIPTION

Figure 1:
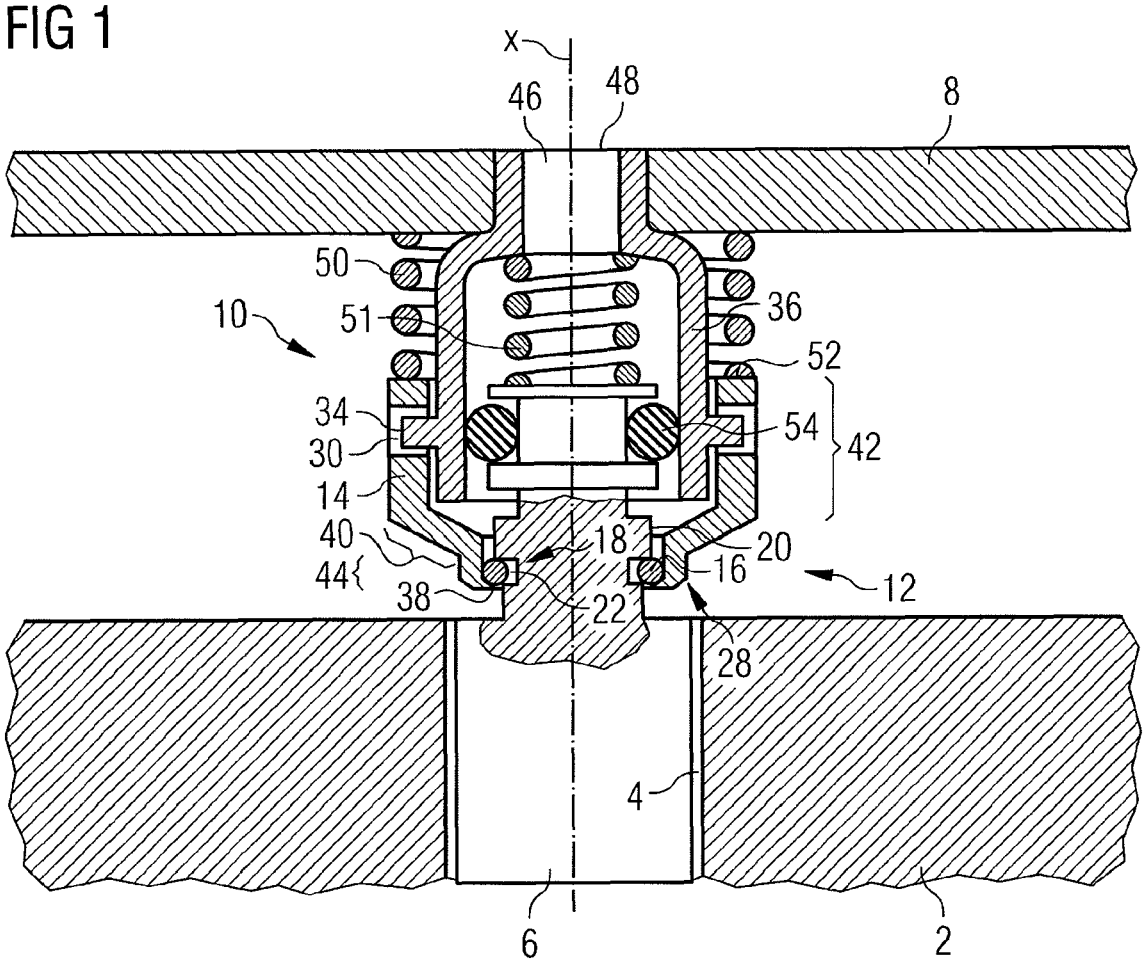
FIG. 1 an exemplary connection assembly with a first embodiment of a coupling arrangement, FIG. 2 the first embodiment of the coupling arrangement, FIG. 3 a side view of a locking element, FIG. 4 a second embodiment of the coupling arrangement.

Concerning a first aspect, according to various embodiments, a coupling arrangement may comprise a housing comprising a first locking part, a locking element and a ring, which is arranged intermediate the locking element and the housing. The locking element is cylindrical having a center axis and comprises a second locking part and at least one locking contour having a first end designed to take in a respective pin of a connecting element to disable rotational movement of the connecting element via positive locking. The ring, the first locking part and the second locking part are designed and arranged such as to form a positive locking at least in one direction of the center axis between the housing and the locking element via the ring.

The locking element with its second locking part combined with the ring and the first locking part of the housing of a connection body enable the coupling of the connection body to the locking element via positive locking in a very fast and simple way. For example, the housing of the connection body conforms to the housing of an injector and therewith a simple coupling of the injector to the locking element is enabled. Furthermore, via the locking contour of the locking element, the connection body such as the injector may be coupled to a connecting element by at least one pin. Thus, rotational movement can be disabled. Therefore, the connection body such as the injector may be fixed via the ring and the locking element to a connecting element in a very fast and simple way without the need for special tools. Furthermore, the ring prevents the housing of the connection body to be released from the locking element and enables an elastic connection between the housing and the locking element without a slot.

According to a further embodiment, the first locking part of the housing comprises a first protrusion designed to form a first area of contact for the ring.

By this, a simple and low-cost manufacturing of the first locking part of the housing is achieved.

According to a further embodiment, the first locking part of the housing comprises a first groove designed to at least partly take in the ring.

Thus, the ring can be fixed to the housing in a simple way.

According to yet a further embodiment, the housing is having a larger outer diameter at a first axial end of the first groove than at a second axial end of the first groove.

According to yet a further embodiment, the second locking part of the locking element comprises a second protrusion designed to form a second area of contact for the ring.

By this, a simple and low-cost manufacturing of the second locking part of the locking element is achieved.

According to yet a further embodiment, the second locking part of the locking element comprises a second groove designed to at least partly take in the ring.

Thus, the ring can be fixed to the locking element in a simple way.

According to yet a further embodiment, the locking element is having a larger inner diameter at a first axial end of the second groove than at a second axial end of the second groove.

By this, a positive locking in a very firm and simple way is enabled. In addition, a simple way of assembling the ring in-between the housing and the locking element is facilitated. For example, if additionally the housing forms the counterpart of the locking element by having a larger outer diameter at the first axial end of the first groove than at the second axial end of the first groove, the first locking part and the second locking part of the coupling arrangement will interact via the ring in a way that they enable a positive locking in an especially firm and simple way.

According to yet a further embodiment, the locking element comprises two side portions connected through an intermediate portion, the first side portion having a larger inner diameter than the second side portion with the first side portion comprising the locking contours and the second side portion comprising the second locking part.

Such an embodiment of the locking element enables a fast and simple coupling of the locking element to a connecting element via the locking contours of the locking element and the pins of the connecting element. For example, the locking contours and the pins may be designed and arranged such as to form a closure via a bayonet coupling.

According to yet a further embodiment, the outer diameter of the housing at the first axial end of the first groove and/or the diameter of the housing at the second axial end of the first groove is smaller than the inner diameter of the locking element.

By this, the insertion of the housing in-between the locking element is enabled.

According to yet a further embodiment, the ring is fixed to the first protrusion and/or the first groove of the housing.

A fixation of the ring to the first protrusion and/or the first groove supports the ring not to release and enforces its fixation.

Concerning a second aspect, according to various embodiments, a connection assembly for connecting an injector to a fluid supply comprising the coupling arrangement according to the first aspect, wherein the housing forms part of the injector, and the connecting element, which is fixed to a pipe of the fluid supply, and which communicates with the pipe through a fluid recess at a first axial end area of the connecting element.

The ring, the first locking part and the second locking part enable a positive locking at least in one direction of the center axis between the housing of the injector and the locking element via the ring. The connection assembly enables to hold the injector from its top in its position respecting at least one direction of the center axis and respecting a rotation of the injector around the center axis. The locking contour of the locking element and the pin of the connecting element enable a fixation of the locking element to the connecting element by positive locking. In addition, the ring prevents the locking element to be released from the housing of the injector. The connection assembly enables light, flexible movement in a small range of the locking element relative to the connecting element. So, the connection assembly enables a proper flexible coupling of the injector to the connecting element. Therefore, the connection assembly contributes to a proper flexible coupling of the injector to the fluid supply, especially the axial orientation of the injector. This may contribute to the proper flexible arrangement of the injector to an engine head.

According to a further embodiment of the second aspect, the respective locking contour of the locking element and the respective pin of the connecting element are designed and arranged such as to form a positive locking at least in one direction of the center axis between the locking element and the connecting element.

For instance, the respective locking contour and the respective pin form a positive locking between the locking element and the connecting element at least in the direction of the center axis facing the first axial end area. For example, the locking contours and the pins may be designed and arranged such as to form a closure via a bayonet coupling. So, the locking element may be coupled to the connecting element very fast and in a very simple way without the need for special tools. For example, the locking element of the coupling arrangement is coupled to the connecting element in a way that at least a part of a first side portion of the locking element and the connecting element are forming an overlapping area, and wherein at least one pin of the connecting element is arranged in the overlapping area at the connecting element, wherein the first end of the respective locking contour of the locking element is taking in the respective pin of the connecting element.

According to a further embodiment of the second aspect, the connection assembly comprises three pins of the connecting element and three locking contours of the locking element, each having the first end designed to take in the respective pin of the connecting element to disable rotational movement of the connecting element via positive locking.

By the use of three pins in combination with three locking contours, a possible twist of the assembly is limited compared to the use of two pins in combination with two locking contours or one pin in combination in combination with one locking contour. At the same time, the assembly is not completely stiffly arranged as it would be in the case of four pins in combination with four locking contours. Thus, a slight movement of the locking element relative to the connecting element may be provided. For example, depending on the design of the respective locking contour and the respective pin, a movement in a small range of the locking element relative to the connecting element may be enabled. So, the connection assembly enables a proper flexible coupling of the locking element to the connecting element. If the locking element holds an injector, the connection assembly contributes to a proper flexible coupling of the injector to the fluid supply, especially the axial orientation of the injector. This may contribute to the proper flexible coupling of the injector to an engine head.

According to a further embodiment of the second aspect, the connection assembly comprises an outer spring, which is arranged intermediate the pipe and the locking element. The outer spring is designed and arranged such as to force the locking element away from the pipe.

The locking contours of the locking element and the pins of the connecting element enable a fixation of the locking element to the connecting element by positive locking. In addition, the outer spring enables the fixation by press fit. So, the locking element may be fixed firmly to the connecting element very fast and in a very simple way without the need for special tools.

According to a further embodiment of the second aspect, the connection assembly comprises an inner spring, which is arranged in the connecting element having a smaller diameter than the outer spring. The inner spring is designed and arranged such as to force the housing of the injector away from the pipe.

The inner spring is fixed to the connecting element at one axial end of the inner spring facing the first axial end area of the connecting element and enables to hold down the injector.

An engine head 2 (FIG. 1) has a recess 4. A housing 6 of an injector is arranged in the recess 4 of the engine head 2. The housing 4 of the injector is coupled to a pipe 8 of a fluid supply by a connection assembly 10. The connection assembly 10 comprises a coupling arrangement 12.

The coupling arrangement 12 comprises the housing 6, a locking element 14 and a ring 16.

The housing 6 comprises a first locking part 18, which comprises a first protrusion 20 designed to form a first area of contact for the ring 16 and a first groove 22 designed to at least partly take in the ring 16. At a first axial end 24 of the first groove 22, the housing 6 is having a larger outer diameter than at a second axial end 26 of the first groove 22.

The locking element 14 is cylindrical having a center axis X and comprises a second locking part 28 and two locking contours 30 having a first end 32 designed to take in a respective pin 34 of a connecting element 36 to disable rotational movement of the connecting element 36 via positive locking. The pin 34 needs not to completely penetrate through the locking element 14. The second locking part 28 of the locking element 14 comprises a second protrusion 38 designed to form a second area of contact for the ring 16. The ring 16, the first locking part 18 and the second locking part 28 are designed and arranged such as to form a positive locking at least in one direction of the center axis X between the housing 6 and the locking element 14 via the ring 16. The locking element 14 comprises two side portions connected through an intermediate portion 40, the first side portion 42 is having a larger inner diameter than the second side portion 44 with the first side portion 42 comprising the locking contour 30 and the second side portion 44 comprising the second locking part 28. For example, the locking contours 30 and the pins 34 may be designed and arranged such as to form a closure via a bayonet coupling. Such an embodiment of the locking element 14 enables a fast and simple coupling of the locking element 14 to the connecting element 36. In addition, such an embodiment of the locking element 14 completely surrounds the housing 6 of the injector without leaving any open slot.

The ring 16 is arranged intermediate the locking element 14 and the housing 6. For example, the ring 16 can be fixed to the first protrusion 20 and the first groove 22 of the housing 6 to support the ring 16 not to be released. Alternatively, the ring 16 can be fixed to the first protrusion 20 or the first groove 22 of the housing 6. The ring 16 prevents the housing 6 of the injector to be released from the locking element 14 and enables an elastic connection between the housing 6 and the locking element 14 without a slot.

In the case of a fluid injection system, the connecting element 36 may be a fuel connection. The connecting element 36 communicates with the pipe 8 through a fluid recess 46 at a first axial end area 48 of the connecting element 36. The pins 34 of the connecting element 36 are arranged at an outside of the connecting element 36 in an overlapping area, which is formed by at least a part of the first side portion 42 of the locking element 14 and by at least a part of the connecting element 36. The respective locking contour 30 of the locking element 14 and the respective pin 34 of the connecting element 36 are designed and arranged such as to form a positive locking at least in one direction of the center axis X between the locking element 14 and the connecting element 36. For instance, the respective locking contour 30 and the respective pin 34 form a positive locking between the locking element 14 and the connecting element 36 at least in the direction of the center axis X facing the first axial end area 48 of the connecting element 36.

The locking element 14 is pressed away from the pipe 8 by an outer spring 50. The outer spring 50 is circumferentially arranged around an axial section of the connecting element 36 and intermediate the pipe 8 and the locking element 14. The outer spring 50 enables the fixation by press fit. So, the locking element 14 may be fixed firmly to the connecting element 36 very fast and in a very simple way without the need for special tools.

Furthermore, an inner spring 51 is arranged in the connecting element 36, which is having a smaller diameter than the outer spring 50. The inner spring 51 forces the housing 6 of the injector away from the pipe 8 in its seat in the recess 4 of the engine head 2. The inner spring 51 is fixed to the connecting element 36 at one axial end of the inner spring 51 facing the first axial end area 48 of the connecting element 36 and enables to hold down the injector.

Preferably, the outer diameter of the housing 6 at the first axial end 24 of the first groove 22 and the diameter of the housing 6 at the second axial end 26 of the first groove 22 may be smaller than the inner diameter of the locking element 14

Figure 2:
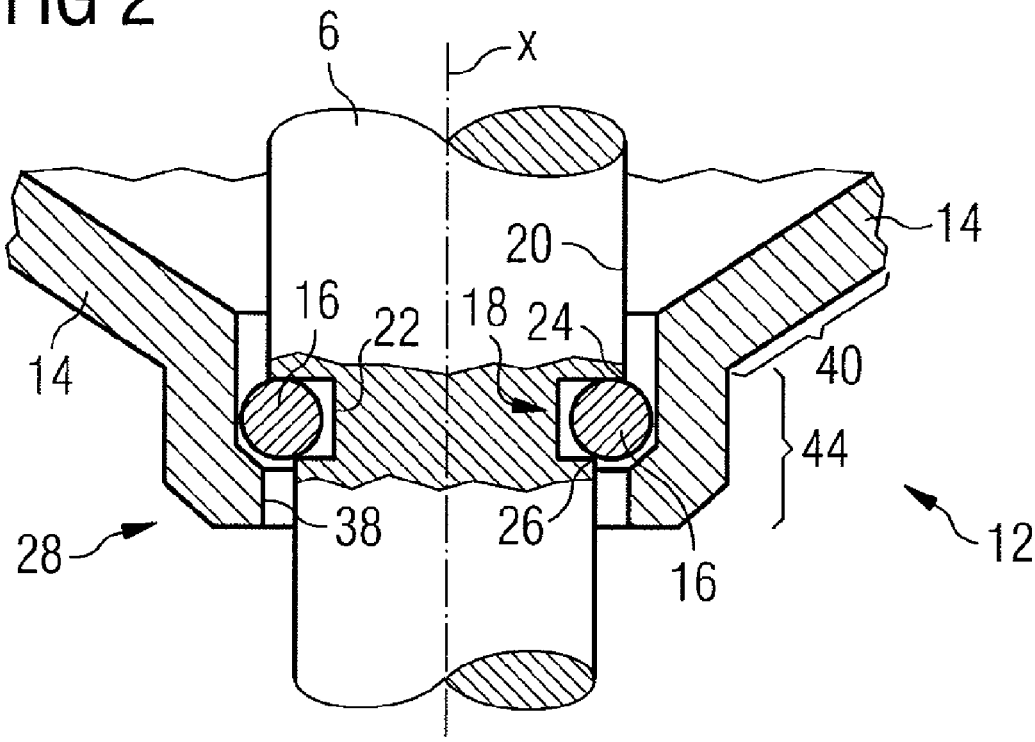

(FIG. 2). This allows, for example, the insertion of the housing 6 in-between the locking element 14.

Figure 3:
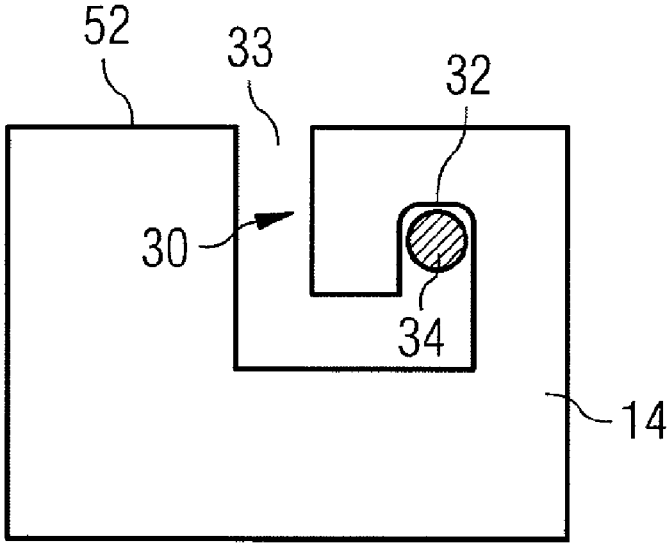

The locking contour 30 (FIG. 3) of the locking element 14 extends from a second end 33 of the locking contour 30 to the first end 32 of the locking contour 30. For example, the locking contour 30 extends in a first direction from a rim 52 of the locking element 14 towards the second side portion 44 of the locking element 14 and then further extends at least partly perpendicular to the first direction and then further extends towards the rim 52 of the locking element 14 to the first end 32 of the locking contour 30 of the locking element 14. The design of the locking contour 30 of the locking element 14 enables a positive locking between the locking element 14 and the connecting element 36 at least in one direction of the center axis X between the locking element 14 and the connecting element 36, for example in the direction of the center axis X facing the first axial end area 48 of the connecting element 36. Furthermore, the locking contour 30 disables rotational movement of the connecting element 36.

When the housing 6 of the injector is assembled to the fluid supply, at first the locking element 14 is pre-arranged to the housing 6 of the injector in such a way that the second locking part 28 of the locking element 14 is axially arranged below the first locking part 18 of the housing 6 of the injector, that is in the direction of the center axis X of the locking element 14 facing away from the first axial end area 48 of the connecting element 36. Preferably, the locking element 14 can be pre-arranged to the housing 6 of the injector by putting it over the top part of the housing 6, that is in the direction of the center axis X of the locking element 14 starting from the first axial end area 48 of the connecting element 36. Then, the ring 16 is arranged at the first locking part 18, for example at the first groove 22. Afterwards, the locking element 14 is arranged in such a way that the second locking part 28 of the locking element 14 is axially arranged at the first locking part 18 of the housing 6 of the injector. Preferably, the ring 16 at the first locking part 18 may have a larger outer diameter than the inner diameter of the locking element 14. Then, the locking element 14 is stuck onto the connecting element 36 in such a way that the second end 33 of the locking contour 30 of the locking element 14 takes in the respective pin 34 of the connecting element 36. Then, the locking element 14 is forced further towards the pipe 8 and therewith the respective pin 34 of the connecting element 36 follows the locking contour 30 of the locking element 14. If the pin 34 of the connecting element 36 reaches the part, which is at least partly perpendicular to the first direction of the locking contour 30 of the locking element 14, the locking element 14 has to be turned in such a way that after the turn the pin 34 of the locking element 14 is arranged underneath the first end 32 of the locking contour 30 of the locking element 14, with respect to FIG. 3. Then, the outer spring 50 presses the locking element 14 away from the pipe 8 in such a way that the first end 32 of the locking contour 30 of the locking element 14 is pressed against the pin 34 of the connecting element 36. So, the outer spring 50 enables a press fit of the locking element 14 to the connecting element 36.

In this way, the locking element 14 and therewith the housing 6 of the injector are fixed to the connecting element 36 by a positive locking and by a press fit. This contributes to a proper coupling of the injector to the fluid supply in a very easy and very fast way. Therefore, this contributes to low costs for manufacturing the connection assembly 10.

Preferably, an O-ring seal 54 can be arranged between the housing 6 of the injector and the connecting element 36, in order to have a proper sealing between the housing 6 of the injector and the connecting element 36.

The invention is not restricted by the explained embodiments. For example, the locking contour 30 of the locking element 14 comprises alternative shapes. Further, the connecting element 36 may comprise one or more pins 34.

For example, the connection assembly 10 may comprise three pins 34 of the connecting element 36 and three locking contours 30 of the locking element 14, each having the first end 32 designed to take in the respective pin 34 of the connecting element 36 to disable rotational movement of the connecting element 36 via positive locking. By the use of three pins 34 in combination with three locking contours 30, a possible twist of the assembly is limited compared to the use of two pins 34 in combination with two locking contours 30 or one pin 34 in combination with one locking contour 30. At the same time, the connection assembly 10 is not completely statically arranged as it would be in the case of four pins 34 in combination with four locking contours 30. Thus, a light flexible movement in a small range of the locking element 14 relative to the connecting element 36 is provided. So, the connection assembly 10 enables a proper flexible coupling of the locking element 14 to the connecting element 36. If the locking element 14 holds the housing 6 of an injector, the connection assembly 10 contributes to a proper flexible coupling of the injector to the fluid supply, especially the axial orientation of the injector. This may contribute to the proper flexible coupling of the injector to the engine head 2.

Figure 4:
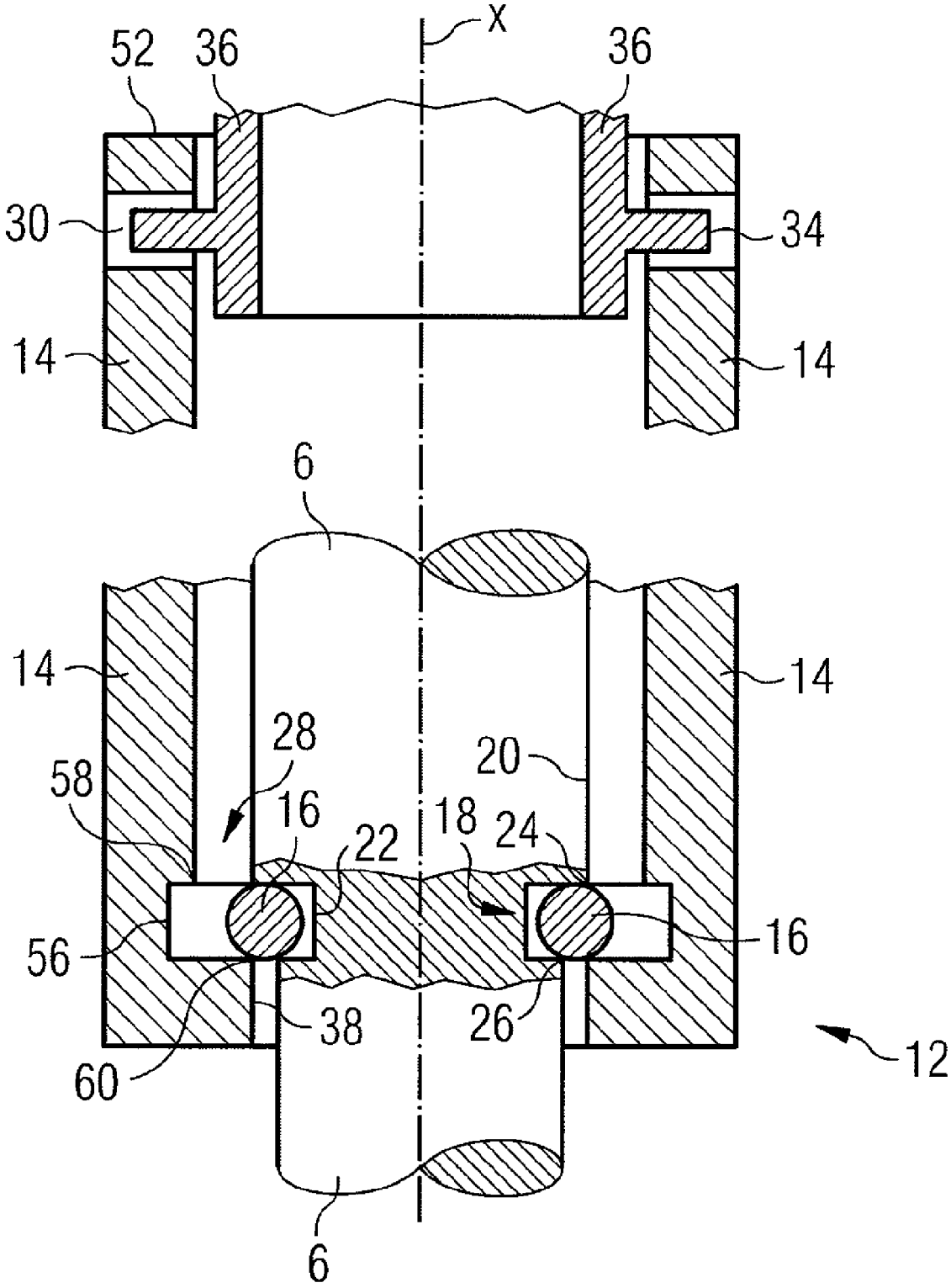

FIG. 4 shows a further embodiment of the coupling arrangement 12. The first locking part 18 of the housing 6 comprises the first protrusion 20 designed to form the first area of contact for the ring 16 and the first groove 22 designed to at least partly take in the ring 16. Preferably, at the first axial end 24 of the first groove 22, the housing 6 may have a larger outer diameter than at the second axial end 26 of the first groove 22, wherein vice versa is also possible. The second locking part 28 of the locking element 14 comprises the second protrusion 38 designed to form the second area of contact for the ring 16 and a second groove 56 designed to at least partly take in the ring 16. Preferably, at a first axial end 58 of the second groove 56, the locking element 14 may have a larger inner diameter than at a second axial end 60 of the second groove 56, wherein vice versa is also possible. By such an embodiment of the coupling arrangement 12, the first locking part 18 and the second locking part 28 of the coupling arrangement 10 will interact via the ring 16 in a way that they enable a positive locking in a very firm and simple way.

The outer diameter of the housing 6 at the first axial end 24 of the first groove 22 and the diameter of the housing 6 at the second axial end 26 of the first groove 22 is smaller than the inner diameter of the locking element 14 to allow the insertion of the housing 6 in-between the locking element 14.

For example, the ring 16 is fixed to the first protrusion 20 and the first groove 22 of the housing 6, which supports the ring 16 not to release and enforces its fixation. Alternatively, the ring 16 can be fixed to the first protrusion 20 or the first groove 22 of the housing 6.

In a further embodiment, the first locking part 18 and the second locking part 28 may also only comprise the first protrusion 20 and the second protrusion 38, respectively.

In a further embodiment, the first locking part 18 and the second locking part 28 may only comprise the first groove 22 and the second groove 56, respectively.

In a further embodiment, the first locking part 18 may only comprise the first protrusion 20 and the second locking part 28 may comprise the second groove 56.

In a further embodiment, the first locking part 18 may only comprise the first groove 22 and the second locking part 28 may only comprise the second protrusion 38.

In a further embodiment, the first locking part 18 may only comprise the first groove 22 and the second locking part 28 may comprise the second protrusion 38 and the second groove 56.

The first locking part 18 and the second locking part 28 are not restricted by the explained embodiments and may also be embodied in every possible combination of their respective detailed embodiments.

What is claimed is:

1. A coupling arrangement comprising:

a housing comprising a first locking part, a connecting element comprising a pin, and a locking element separate from said housing and said connecting element for coupling of the same, wherein the locking element is cylindrical having a center axis comprising:

a second locking part, and at least one locking contour having a first end designed to take in the pin of the connecting element to disable rotational movement of the connecting element via positive locking, and a ring, which is arranged intermediate the locking element and the housing, wherein the ring, the first locking part and the second locking part being designed and arranged such as to form a positive locking at least in one direction of the center axis between the housing and the locking element via the ring.

2. The coupling arrangement according to claim 1, wherein the first locking part of the housing comprises a first protrusion designed to form a first area of contact for the ring.

3. The coupling arrangement according to claim 1, wherein the first locking part of the housing comprises a first groove designed to at least partly take, in the ring.

4. The coupling arrangement according to claim 1, wherein at a first axial end of the first groove the housing is having a larger outer diameter than at a second axial end of the first groove.

5. The coupling arrangement according to claim 1, wherein the second locking part of the locking element comprises a second protrusion designed to form a second area of contact for the ring.

6. The coupling arrangement according to claim 1, wherein the second locking part of the locking element comprises a second groove designed to at least partly take in the ring.

7. The coupling arrangement according to claim 1, wherein at a first axial end of the second groove the locking element is having a larger inner diameter than at a second axial end of the second groove.

8. The coupling arrangement according to claim 1, wherein the locking element comprises two side portions connected through an intermediate portion, the first side portion having a larger inner diameter than the second side portion with the first side portion comprising the locking contour and the second side portion comprising the second locking part.

9. The coupling arrangement according to claim 1, wherein at least one of the outer diameter of the housing at the first axial end of the first groove and the diameter of the housing at the second axial end of the first groove is smaller than the inner diameter of the locking element.

10. The coupling arrangement according to claim 1, wherein at least one of the outer diameter of the housing at the first protrusion and at the part of the housing along the center axis extending away from the first area of contact is smaller than the inner diameter of the locking element.

11. The coupling arrangement according to claim 1, wherein the ring is fixed to at least one of the first protrusion and the first groove of the housing.

12. A connection assembly for connecting an injector to a fluid supply comprising a coupling arrangement comprising:

a housing comprising a first locking part, a connecting element comprising a pin, and a locking element which is cylindrical having a center axis and arranged between the housing and the connecting element, comprising:

a second locking part, at least one locking contour having a first end designed to take in the pin of the connecting element to disable rotational movement of the connecting element around the center axis via positive locking, and a ring, which is arranged intermediate the locking element and the housing, wherein the ring, the first locking part and the second locking part being designed and arranged such as to form a positive locking at least in one direction of the center axis between the housing and the locking element via the ring, wherein the housing forms part of the injector, and wherein the connecting element, which is fixed to a pipe of the fluid supply, communicates with the pipe through a fluid recess at a first axial end area of the connecting element.

13. The connection assembly according to claim 12, wherein the respective locking contour of the locking element and the respective pin of the connecting element being designed and arranged such as to form a positive locking at least in one direction of the center axis between the locking element and the connecting element.

14. The connection assembly according to claim 12, comprising three pins of the connecting element and three locking contours of the locking element each having the first end designed to take in the respective pin of the connecting element to disable rotational movement of the connecting element via positive locking.

15. The connection assembly according to claim 12, comprising an outer spring, which is arranged intermediate the pipe and the locking element, the outer spring being designed and arranged such as to force the locking element away from the pipe.

16. The connection assembly according to claim 12, comprising an inner spring, which is arranged in the connecting element having a smaller diameter than the outer spring, the inner spring being designed and arranged such as to force the housing of the injector away from the pipe.

17. The connection assembly according to claim 12, wherein the first locking part of the housing comprises a first protrusion designed to form a first area of contact for the ring.

18. The connection assembly according to claim 12, wherein the first locking part of the housing comprises a first groove designed to at least partly take in the ring.

19. The connection assembly according to claim 12, wherein at a first axial end of the first groove the housing is having a larger outer diameter than at a second axial end of the first groove.

20. The connection assembly according to claim 12, wherein the second locking part of the locking element comprises a second protrusion designed to form a second area of contact for the ring.

* * * * *